US010770822B2

(12) United States Patent
Maesoba et al.

(10) Patent No.: US 10,770,822 B2
(45) Date of Patent: Sep. 8, 2020

(54) SHIELD TERMINAL

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hiroyoshi Maesoba, Mie (JP); Toshifumi Ichio, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/483,451

(22) PCT Filed: Jan. 15, 2018

(86) PCT No.: PCT/JP2018/000738
§ 371 (c)(1),
(2) Date: Aug. 5, 2019

(87) PCT Pub. No.: WO2018/142885
PCT Pub. Date: Aug. 9, 2018

(65) Prior Publication Data

US 2020/0036129 A1 Jan. 30, 2020

(30) Foreign Application Priority Data

Feb. 3, 2017 (JP) ..... 2017-018548

(51) Int. Cl.
*H01R 13/436* (2006.01)
*H01R 13/58* (2006.01)
(Continued)

(52) U.S. Cl.
CPC ..... *H01R 13/4364* (2013.01); *H01R 13/5808* (2013.01); *H01R 13/6582* (2013.01); *H01R 13/6592* (2013.01)

(58) Field of Classification Search
USPC ..... 439/607.47, 607.48
See application file for complete search history.

(56) References Cited

U.S. PATENT DOCUMENTS 5,273,459 A * 12/1993 Davis ..... H01R 13/6593 439/607.48
6,565,388 B1 * 5/2003 Van Woensel ..... H01R 13/514 439/607.48
(Continued)

FOREIGN PATENT DOCUMENTS

JP 7-254454 10/1995
JP 2012-129103 7/2012
(Continued)

OTHER PUBLICATIONS

International Search Report dated Mar. 20, 2018.

*Primary Examiner* — Gary F Paumen
(74) *Attorney, Agent, or Firm* — Gerald E. Hespos; Michael J. Porco; Matthew T. Hespos

(57) ABSTRACT

It is aimed to improve assembling workability and the reliability of a shielding function. A shield terminal includes inner conductors (52) to be connected to front end parts of cores (62) of a shielded cable (60), a dielectric (46) configured to accommodate the inner conductors (52), a tubular member (12) constituting an outer conductor (10) and configured to surround and hold the dielectric (46), a lower member (18) separate from the tubular member (12), constituting the outer conductor (10) and including a crimping portion (32) connectable to a shield layer (65) of the shielded cable (60), a first hooking portion (22) formed on a front end part of the lower member (18) and lockable to a rear end
(Continued)

edge part of the tubular member (12), and a first guide means (28) configured to guide the lower member (18) to a proper assembly position while allowing the lower member (18) to swing with the first hooking portion (22) as a fulcrum.

2 Claims, 14 Drawing Sheets

(51) Int. Cl.
*H01R 13/6582* (2011.01)
*H01R 13/6592* (2011.01)

(56) References Cited

U.S. PATENT DOCUMENTS

| | | | | |
|---|---|---|---|---|
| 7,909,647 | B2 * | 3/2011 | Kawaguchi | H01R 9/035 439/585 |
| 2014/0302714 | A1 * | 10/2014 | Luettermann | H01R 13/6581 439/607.55 |
| 2014/0349523 | A1 * | 11/2014 | Peng | H01R 13/6593 439/701 |
| 2016/0093983 | A1 * | 3/2016 | Tanaka | H01R 13/6593 439/607.55 |
| 2016/0093984 | A1 * | 3/2016 | Iwamoto | H01R 13/6581 439/607.55 |
| 2019/0173243 | A1 * | 6/2019 | Annequin | H01R 13/6473 |
| 2020/0021064 | A1 * | 1/2020 | Maesoba | H01R 4/184 |

FOREIGN PATENT DOCUMENTS

| | | |
|---|---|---|
| JP | 2012-195315 | 10/2012 |
| JP | 2014-532286 | 12/2014 |
| JP | 2016-72067 | 5/2016 |

* cited by examiner

SHIELD TERMINAL

BACKGROUND

Field of the Invention

The invention relates to a shield terminal.

Related Art

Japanese Unexamined Patent Publication No. 2012-129103 discloses a shield terminal with an outer terminal, an inner terminal and a dielectric. A holding portion is formed in a front part of the outer terminal and the dielectric is held in the holding portion. The inner terminal is mounted in the dielectric, and is connected to a core of a shielded cable. A crimping portion in the form of an open barrel is formed in a rear end part of the outer terminal, and is connected to a shield layer of the shielded cable. The holding portion of the outer terminal has a half-divided shape. When the outer terminal and a mating outer terminal are connected, the holding portion of the outer terminal and a holding portion of the mating outer terminal having a half-divided shape are united to surround the dielectric over the entire periphery.

With the holding portions of the outer terminals united, a clearance may be formed between the holding portions and a shielding function may be reduced due to this clearance. As a countermeasure against this, it is considered to form the holding portion into a tubular shape continuous over the entire periphery. However, if the holding portion is formed into a tubular shape, the dielectric may interfere with the crimping portion to make an operation difficult when an attempt is made to mount the dielectric into the holding portion from the side of the crimping portion.

The invention was completed on the basis of the above situation and aims to improve assembling workability and improve the reliability of a shielding function.

SUMMARY

The invention is directed to a shield terminal with an inner conductor to be connected to a front end part of a core of a shielded cable, a dielectric configured to accommodate the inner conductor, and a tubular member constituting an outer conductor. The tubular member surrounds and holds the dielectric. A connecting member is separate from the tubular member and constitutes the outer conductor. The connecting member includes a crimping portion connectable to a shield layer of the shielded cable and a hook formed on a front end part of the connecting member. The hook is lockable to a rear end of the tubular member. A guide means is configured to guide the connecting member to a proper assembly position while allowing the connecting member to swing with the hooking portion as a fulcrum.

The dielectric is surrounded by the tubular member. Thus, the reliability of a shielding function is improved. The crimping portion is not present behind the tubular member in a state before the connecting member is assembled with the tubular member. Thus, work efficiency is good when mounting the dielectric into the tubular member from behind is good. Further, the connecting member is guided by the guide means when assembling the connecting member with the tubular member for further improving work efficiency.

The crimping portion may be crimped to an outer periphery of the shield layer, and the hook may be locked to an inner peripheral edge part of the tubular member. According to this configuration, the front part of the connecting member is going to be lifted and displaced radially outward by a reaction force during crimping in crimping the crimping portion to the shield layer. However, the hook formed on the front end part of the connecting member is locked to an inner edge part of a rear end part of the tubular member. Thus, the lift of the front end part of the connecting member can be prevented.

The guide means is formed in the connecting member and the dielectric. According to this configuration, the shape of the tubular member can be simplified as compared to the case where the tubular member is formed with a guide means.

The guide means may include a guide pin formed on one of the dielectric and the connecting member and a guide groove formed in the other of the dielectric and the connecting member. The guide pin may slide in contact with the guide groove. According to this configuration, the tubular member need not be formed with the guide means. Thus, the shape of the tubular member can be simplified.

DETAILED DESCRIPTION

Hereinafter, one specific embodiment of the present invention is described with reference to FIGS. 1 to 14. Note that, in the following description, a left side in FIGS. 1 to 14 is defined as a front side concerning front-rear directions of a shield connector 1 and a shield terminal T. Upper and lower sides shown in FIGS. 1 to 14 are directly defined as upper and lower sides concerning a vertical direction.

Figure 1:
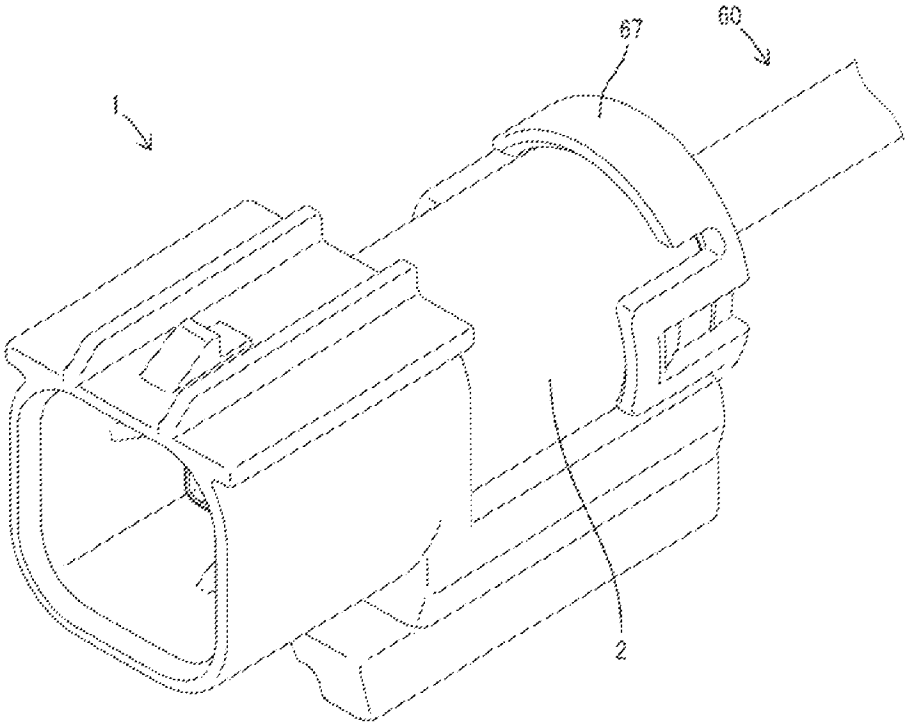
FIG. 1 is a perspective view of a shield connector.
Figure 2:
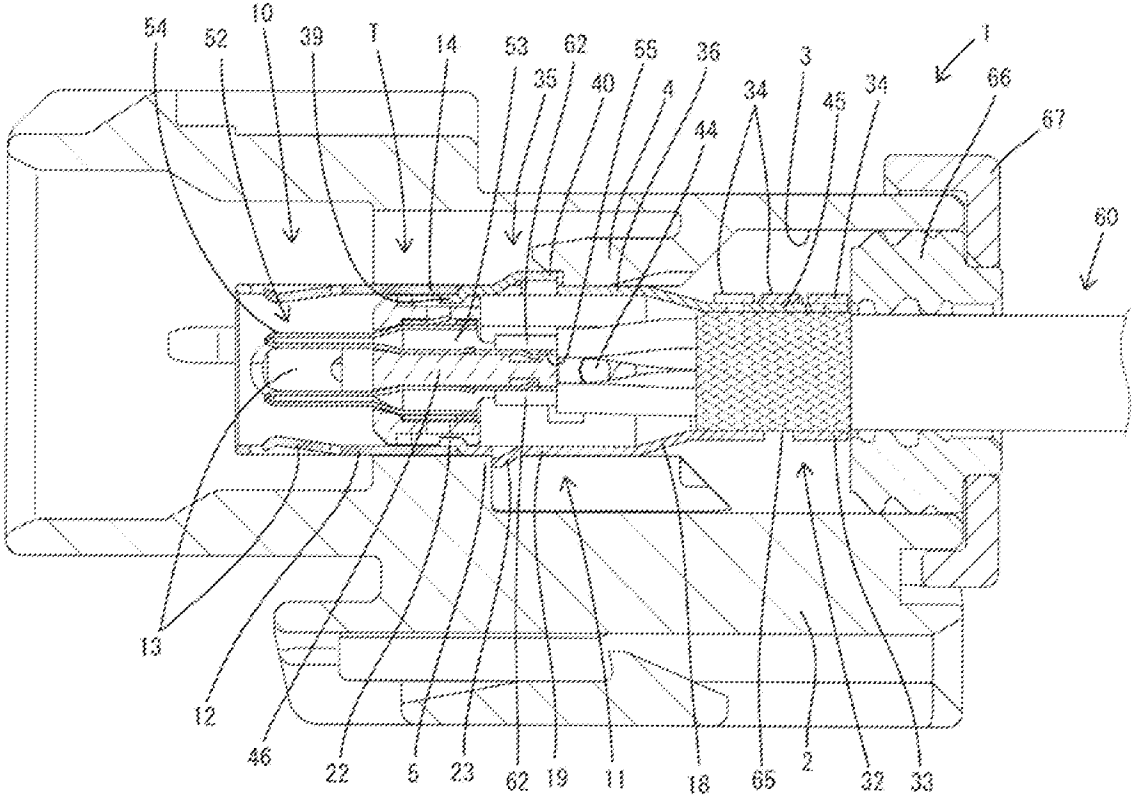
FIG. 2 is a side view in section of the shield connector.

The shield connector 1 includes a housing 2 made of synthetic resin and the shield terminal T. As shown in FIG. 2, a terminal accommodation chamber 3 extends through the housing 2 from the front end to the rear end, and the shield terminal T is inserted into the terminal accommodation chamber 3 from behind the housing 2. A resiliently deflectable locking lance 4 is formed at an upper surface part of the terminal accommodation chamber 3 and restricts the rearward escape of the shield terminal T from the terminal accommodation chamber 3. Further, a lower surface part of the terminal accommodation chamber 3 is formed with a front stop 5 for stopping the shield terminal T inserted into the terminal accommodation chamber 3 and preventing further forward movement.

Figure 3:
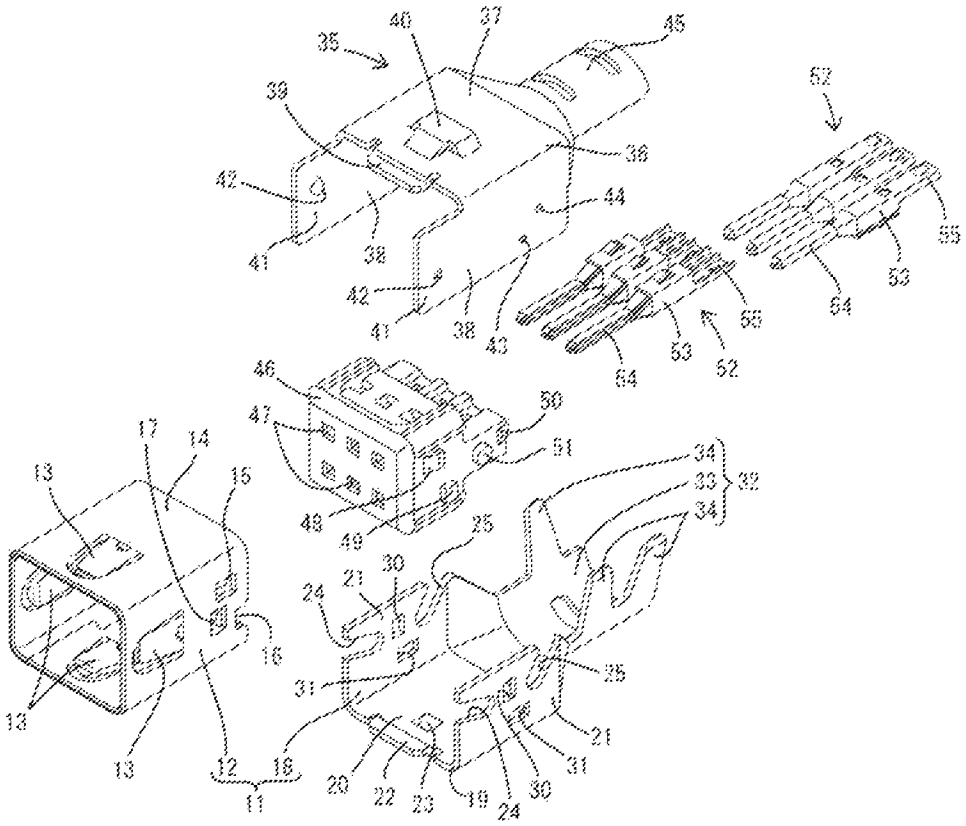
FIG. 3 is an exploded perspective view of a shield terminal.
Figure 4:
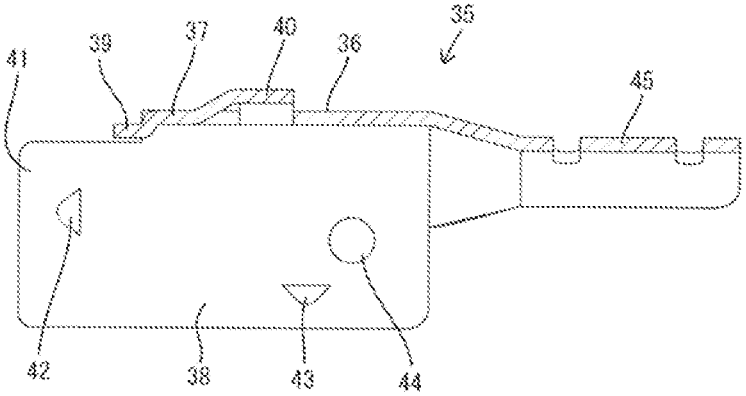
FIG. 4 is a side view in section of an upper member.

As shown in FIG. 3, the shield terminal T is configured by assembling an outer conductor 10 made of metal, a dielectric 46 made of synthetic resin and inner conductors 52 made of metal. The outer conductor 10 is configured by assembling a body 11 and an upper member 35, which is a single component separate from the body 11. The body 11 is configured by assembling a tubular member 12 and a lower member 18 (connecting member as claimed). The tubular member 12 and the lower member 18 are separate components. That is, the outer conductor 10 is configured by assembling three components, i.e. the tubular member 12, the upper member 35 and the lower member 18.

The tubular member 12 is a single member formed into a substantially rectangular tube shape by applying bending and the like to a metal plate material having a predetermined shape. The tubular member 12 has such rigidity and shape retention so as not to be expanded and deformed. Four resilient contact pieces 13 are formed respectively in front end areas of four plate parts constituting the tubular member 12. Each resilient contact piece 13 is cantilevered obliquely inward toward the front by cutting and raising a part of each platepart. These resilient contact pieces 13 resiliently contact the outer peripheral surface of a mating outer conductor (not shown).

A rear end area of the tubular member 12 is a substantially rectangular tubular holding portion 14 for holding the dielectric 46. As shown in FIG. 3, a first locking portion 15 in the form of a window, a second locking portion 16 formed by cutting the rear end edge of the holding portion 14 and a third locking portion 17 in the form of a window are formed in each of left and right side plate parts of the holding portion 14. The second locking portions 16 are at positions below and behind the first locking portions 15. The third locking portions 17 are at positions below the first locking portions 15 and in front of the second locking portions 16.

The lower member 18 is formed by applying bending and the like to a metal plate. A front area of the lower member 18 serves as a first cover 19 in which left and right inner plate parts 21 rise from both left and right side edges of a lower plate part 20. A first hook 22 is formed on the lower plate part 20 of the first cover 19. The first hook 22 is in the form of a rib projecting along a front end edge and is shaped into a step ascending with respect to the lower plate part 20 in a side view. The lower plate part 20 of the first cover 19 is formed with a butting portion 23 struck to project down (outwardly of the lower plate part 20).

First and second guide grooves 24 and 25 are formed in each of the left and right inner plate parts 21 of the first cover 19. The first guide groove 24 is formed by being cut obliquely down toward the rear from an upper end part of the front edge of the inner plate part 21 and the second guide groove 25 is formed by being cut obliquely down toward the front from an upper part of the rear edge of the inner plate part 21. A first stopper 26 in the form of a projection is formed at a position of an upper edge part of the first guide groove 24 near a rear end. A second stopper 27 in the form of a projection is formed at a position of an upper edge part of the second guide groove 25 near a front end. The first guide grooves 24 constitute a first guide means 28, and the second guide grooves 25 constitute a second guide means 29.

A fourth locking portion 30 in the form of a window and a fifth locking portion 31 in the form of a window are formed in each of the left and right inner plate parts 21 of the first cover 19. The fourth and fifth locking portions 30, 31 are in a vertically arranged positional relationship, and the fifth locking portion 31 is disposed at a position below the fourth locking portion 30. The fourth and fifth locking portions 30, 31 are disposed between the rear end of the first guide groove 24 and the front end of the second guide groove 25 in the front-rear direction.

A crimping portion 32 in the form of an open barrel is formed on a rear end area of the lower member 18. The crimping portion 32 includes a base plate part 33 having a substantially arcuate cross-section and extending rearward from the rear end of the lower plate part 20 of the first cover 19, and two bilaterally asymmetrical crimping pieces 34 rise from both left and right side edges of the base plate part 33. The crimping portion 32 is conductively fixed to the outer periphery of a shield layer 65 of a shielded cable 60.

The upper member 35 is formed by applying bending and the like to a metal plate. A front area of the upper member 35 serves as a second cover 36 in which left and right outer plate parts 38 extend down from both left and right side edges of an upper plate part 37. A second hook 39 is formed on the upper plate part 37 of the second cover 36. The second hook 39 is a rib projecting along a front end edge and is shaped into a step descending with respect to the upper plate part 37 in a side view. The upper plate part 37 is formed with a retaining projection 40 struck to project up (outwardly of the upper plate part 37).

Front end parts of the both left and right outer plate parts 38 of the second cover 36 project farther forward than the second hook 39 (front end of the upper plate part 37) and function as closing plate parts 41. A third locking projection 42 projecting inward, a fifth locking projection 43 projecting inward and a second guide pin 44 projecting inward are formed on each of the left and right outer plate parts 38. The third locking portions 17 are disposed on front end parts (closing plate parts 41) of the outer plate parts 39. The fifth locking portions 31 are disposed at positions behind the second hook 39. The second guide pins 44 are disposed at positions behind and above the fifth locking portions 31. The second guide pins 44 constitute the second guide means 29.

A rear end area of the upper member 35 is formed with a fixing portion 45 extending rearward from the rear end of the upper plate part 37. The fixing portion 45 has a substantially arcuate cross-sectional shape to face the crimping portion 32 of the lower member 18 from above. The fixing portion 45 is disposed to vertically sandwich a front part of the shield layer 65 of the shielded cable 60 between the crimping portion 32 and the fixing portion 45.

The dielectric 46 is made of synthetic resin and is in the form of a block. Conductor accommodation chambers 47 are formed inside the dielectric 46 and are elongated in the front-rear direction. The conductor accommodation chambers 47 are disposed in separate upper and lower stages and are vertically symmetrical. In a rear end part of the dielectric 46, rear end parts of the conductor accommodation chambers 47 in the upper stage are exposed to an upper-outer side and rear end parts of the conductor accommodation chambers 47 in the lower stage are exposed to a lower-outer side.

A first locking projection 48, a second locking projection 49, a fourth locking projection 50 and a first guide pin 51 (guide pin as claimed) are formed on each of left and right side surfaces of the dielectric 46. The first locking projections 48 are at upper end positions on front end parts of outer side surfaces of the dielectric 46. The second locking projections 49 are at positions below and slightly behind the first locking projections 48. The fourth locking projections 50 are on rear end parts of the outer side surfaces of the dielectric 46. The first guide pins 51 are at positions behind the first and second locking projections 48, 49 and in front of the fourth locking projections 50. The first guide pins 51 constitute the first guide means 28.

The inner conductor 52 is made of metal and has an elongated shape in the front-rear direction as a whole. The inner conductor 52 is formed with a rectangular tubular conductor body 53, an elongated tab 54 cantilevered forward from the conductor body 53 and a wire connecting portion 55 extending rearward from the conductor body 53. Each inner conductor 52 is accommodated into the conductor accommodation chamber 47 from behind the dielectric 46. The inner conductors 52 inserted in the conductor accommodation chambers 47 in the upper stage and the inner conductors 52 inserted in the conductor accommodation chambers 47 in the lower stage are oriented vertically symmetrically.

With the inner conductors 52 mounted in the dielectric 46, the conductor bodies 53 are held in the conductor accommodation chambers 47 and the tabs 54 project forward from the front end surface of the dielectric 46. Further, the wire connecting portions 55 are exposed upwardly of the dielectric 46 in the conductor accommodation chambers 47 in the upper stage, and the wire connecting portions 55 are exposed downwardly of the dielectric 46 in the conductor accommodation chambers 47 in the lower stage. Cores 62 of the shielded cable 60 are connected to the respective wire connecting portions 55 by soldering.

The shielded cable 60 to which the shield terminal T is connected includes thin coated wires 61, the shield layer 65 formed of a braided wire for surrounding the coated wires 61 in a bundled state and a hollow cylindrical sheath 64 surrounding the shield layer 65. The coated wire 61 is composed of the core 62 and an insulation coating 63 surrounding the core 62, and extends forward from the front end of the sheath 64. A front part of the core 62 is exposed by removing the insulation coating 63. A front part of the shield layer 65 extending from the front end of the sheath 64 is folded rearward on an outer peripheral side to cover the outer periphery of the sheath 64.

Figure 5:
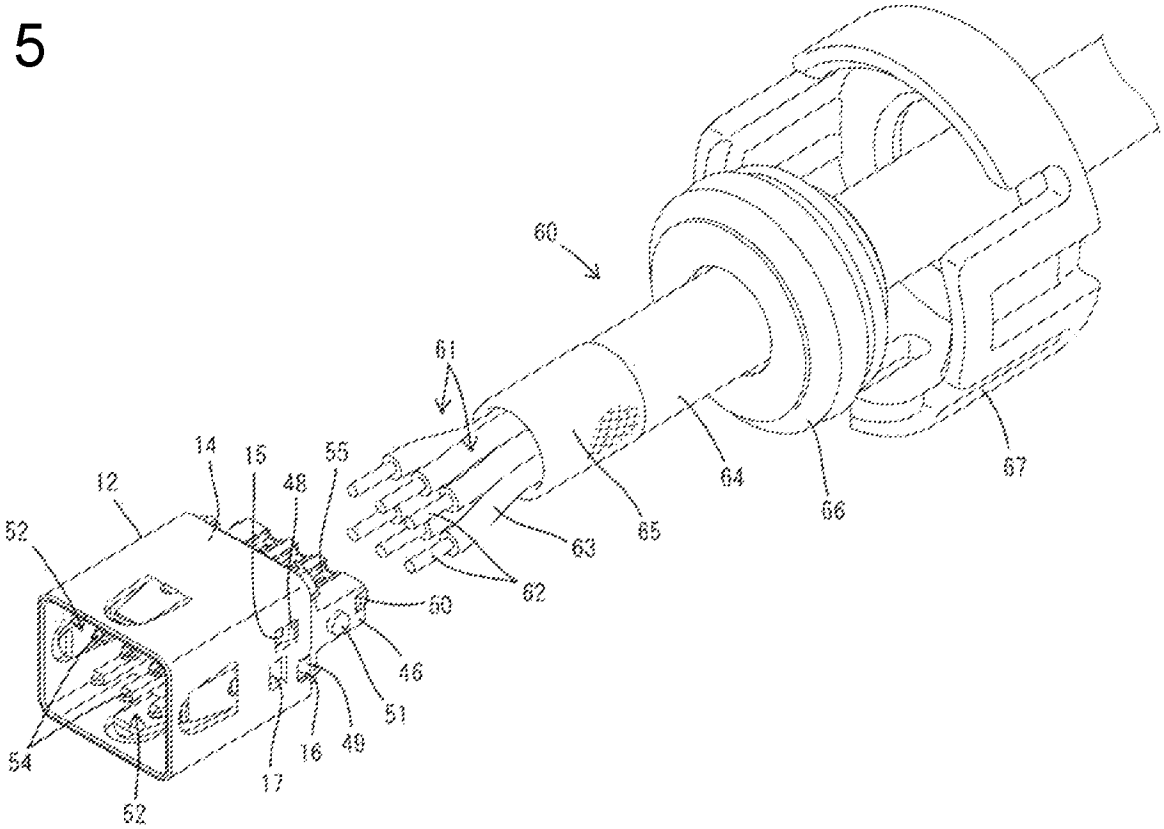
FIG. 5 is a perspective view showing a state before inner conductors and cores are connected.

Next, an assembling procedure of the shield connector 1 of this embodiment is described. First, the inner conductors 52 are mounted into the dielectric 46 and, thereafter, the dielectric 46 is inserted into the tubular member 12 from behind to be assembled. As shown in FIG. 5, with the dielectric 46 mounted in the tubular member 12, the front area of the dielectric 46 is fit in the holding portion 14 of the tubular member 12 and the tabs 54 are surrounded collectively by the tubular member 12.

The tubular member 12 and the dielectric 46 are held in the assembled state by the locking of the first locking portions 15 and the first locking projections 48 and by the locking of the second locking portions 16 and the second locking projections 49. That is, the tubular member 12 and the dielectric 46 are positioned with relative displacements restricted in the front-rear direction, vertical direction and lateral direction. Further, the fourth locking projections 50, the first guide pins 51 and the wire connecting portions 55 of the inner conductors 52 are exposed at positions behind the tubular member 12.

After the dielectric 46 is mounted into the tubular member 12, the front parts of the cores 62 of the shielded cable 60 are connected conductively to the wire connecting portions 55 of the respective inner conductors 52 by soldering. At this time, the cores 62 are placed into the wire connecting portions 55 in the upper stage from above and soldered. The cores 62 are placed into and soldered to the wire connecting portions 55 in the lower stage with the dielectric 46 and the tubular member 12 vertically inverted.

Figure 6:
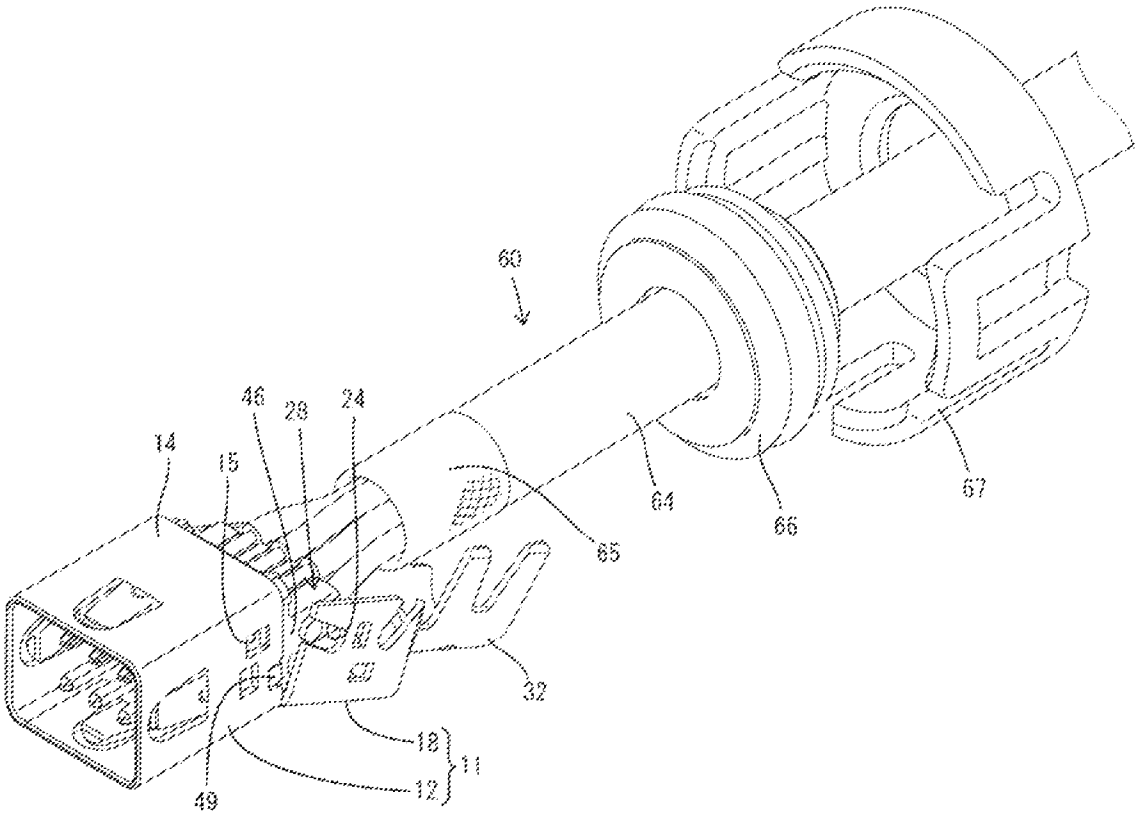
FIG. 6 is a perspective view showing a state where a lower member is being assembled with a tubular member and a dielectric.
Figure 7:
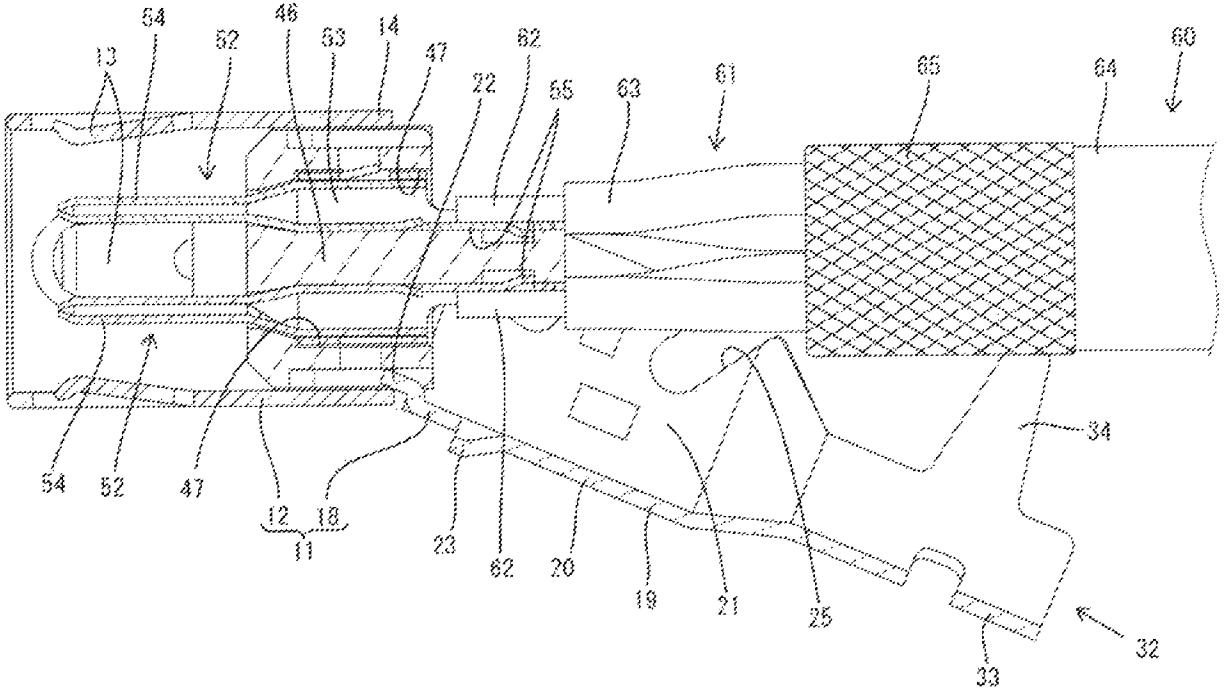
FIG. 7 is a side view in section showing the state where the lower member is being assembled with the tubular member and the dielectric.

After all the cores 62 are connected to the wire connecting portions 55, the lower member 18 is assembled with the tubular member 12 and the dielectric 46. In mounting the lower member 18, the first guide pins 51 are caused to enter the entrances (front end parts) of the first guide grooves 24 and the first hook 22 of the lower member 18 is locked to a lower edge of the rear end of the tubular member 12 (holding portion 14), as shown in FIGS. 6 and 7, and the lower member 18 is swung upward with the locking position as a fulcrum. A swing direction of the lower member 18 during this assembling operation is a direction intersecting an axis of the shielded cable 60.

Figure 8:
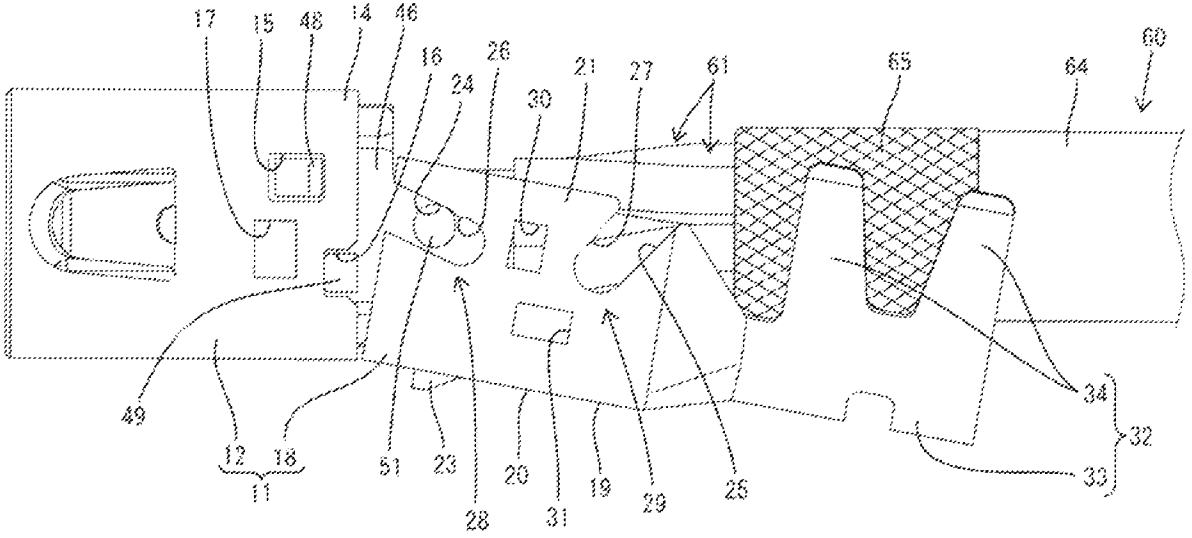
FIG. 8 is a side view showing the state where the lower member is being assembled with the tubular member and the dielectric.
Figure 9:
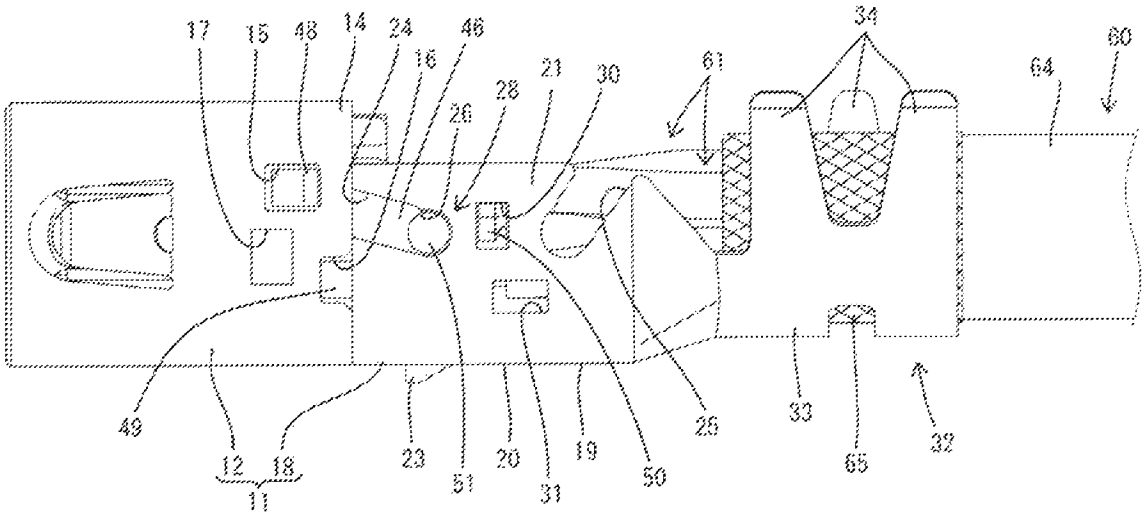
FIG. 9 is a side view showing a state where the lower member is assembled with the tubular member and the dielectric.

In the process of swinging the lower member 18, the first guide pins 51 slide along edges of the first guide grooves 24, as shown in FIG. 8 so that a swing trajectory of the lower member 18 is stabilized in the vertical direction and front-rear direction. Further, the left and right inner plate parts 21 slide in contact with the outer side surfaces of the dielectric 46 to position the lower member 18 in the lateral direction with respect to the dielectric 46 and the tubular member 12. As shown in FIG. 9, when the first guide pins 51 reach the back ends of the first guide grooves 24, the assembling of the lower member 18 with the tubular member 12 and the dielectric 46 is completed and the body 11 of the outer conductor 10 is configured.

With the assembling of the body 11 completed, the first guide pins 51 are locked to the first stoppers 26 and are held in back end parts of the first guide grooves 24. Additionally, the first hook 22 is locked conductively to the rear end edge of the tubular member 12 and the fourth locking portions 30 and the fourth locking projections 50 are locked to each other. Thus, the lower member 18, the tubular member 12 and the dielectric 46 are held in the assembled state with relative displacements in the front-rear direction and vertical direction restricted.

With the lower member 18 mounted on the tubular member 12 and the dielectric 46, an area of the lower member 18 except the first hook 22 is entirely behind and continuous with the tubular member 12. Further, the first cover 19 of the lower member 18 covers side surface parts of the dielectric 46 in an area behind the tubular member 12, exposed areas of the front end parts of the cores 62 and the wire connecting portions 55 of the inner conductors 52 mounted in the conductor accommodation chambers 47 in the lower stage. Further, the crimping portion 32 covers a lower surface area of the outer periphery of the front end part of the shield layer 65.

Figure 10:
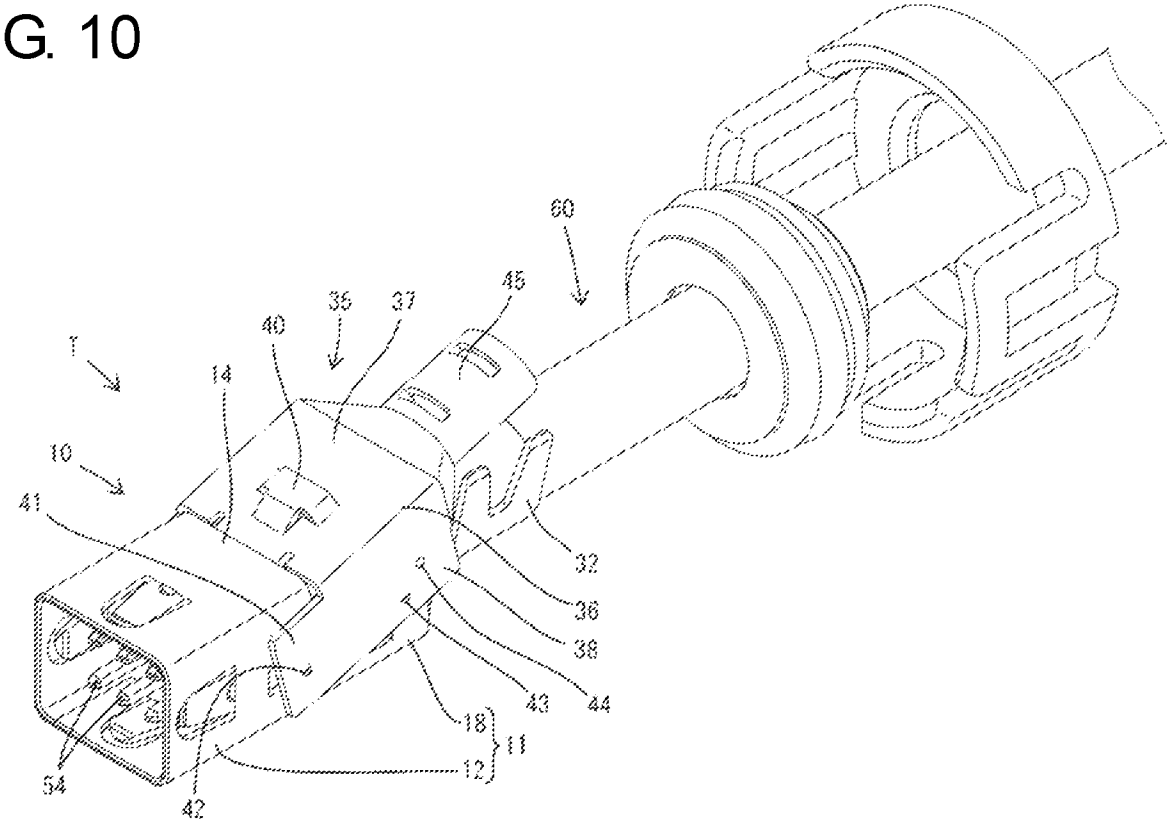
FIG. 10 is a perspective view showing a state where the upper member is being assembled with the tubular member and the lower member.
Figure 11:
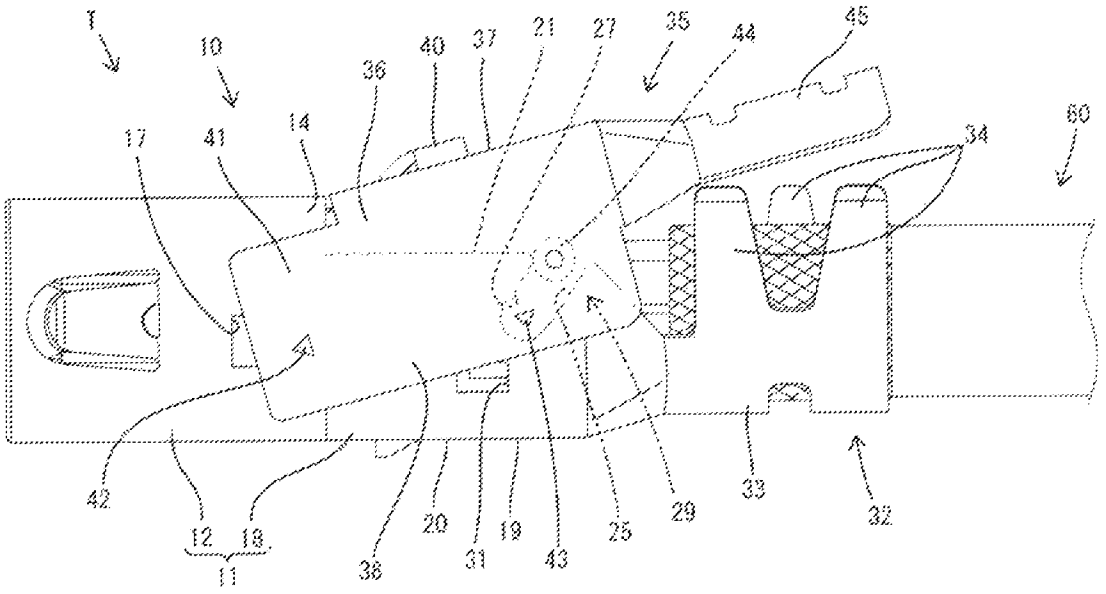
FIG. 11 is a side view showing the state where the upper member is being assembled with the tubular member and the lower member.
Figure 12:
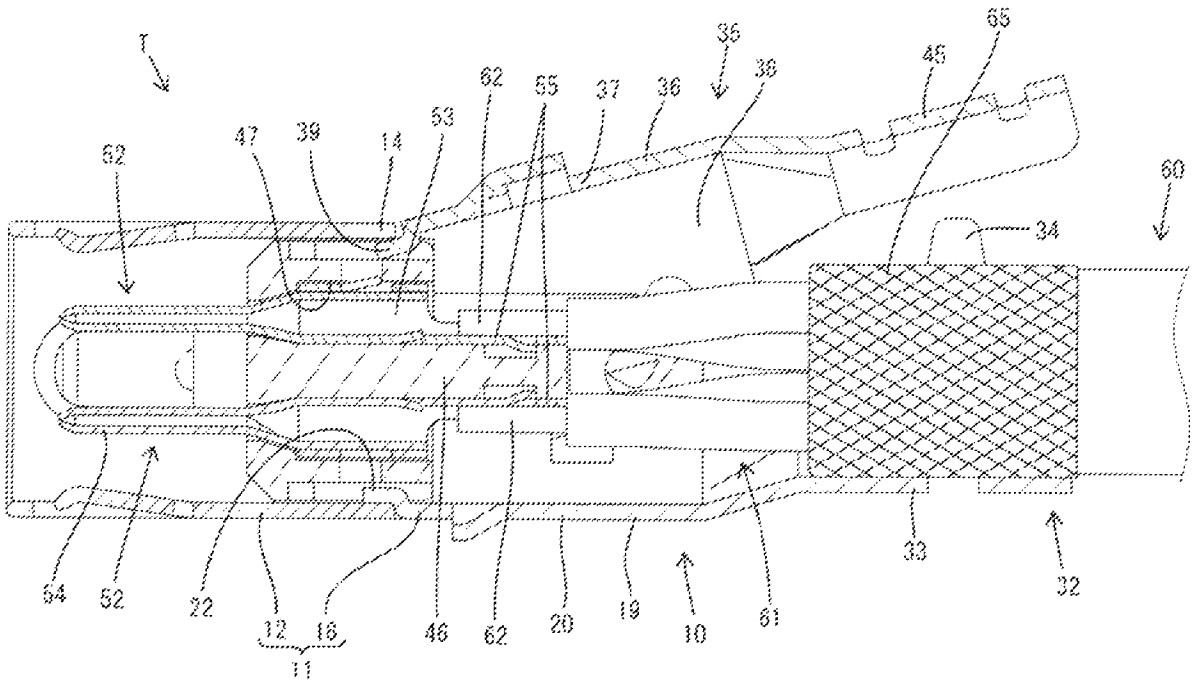
FIG. 12 is a side view in section showing the state where the upper member is being assembled with the tubular member and the lower member.

Thereafter, the upper member 35 is assembled with the body 11. More particularly, the second guide pins 44 are caused to enter the entrances (rear end parts) of the second guide grooves 25 and the second hook 39 of the upper member 35 is locked to an upper edge of the rear end of the tubular member 12 (holding portion 14), as shown in FIGS. 10, 11 and 12. Additionally, the upper member 35 is swung down with the locking position as a fulcrum. A swing direction during this assembling operation is a direction intersecting the axis of the shielded cable 60.

Figure 13:
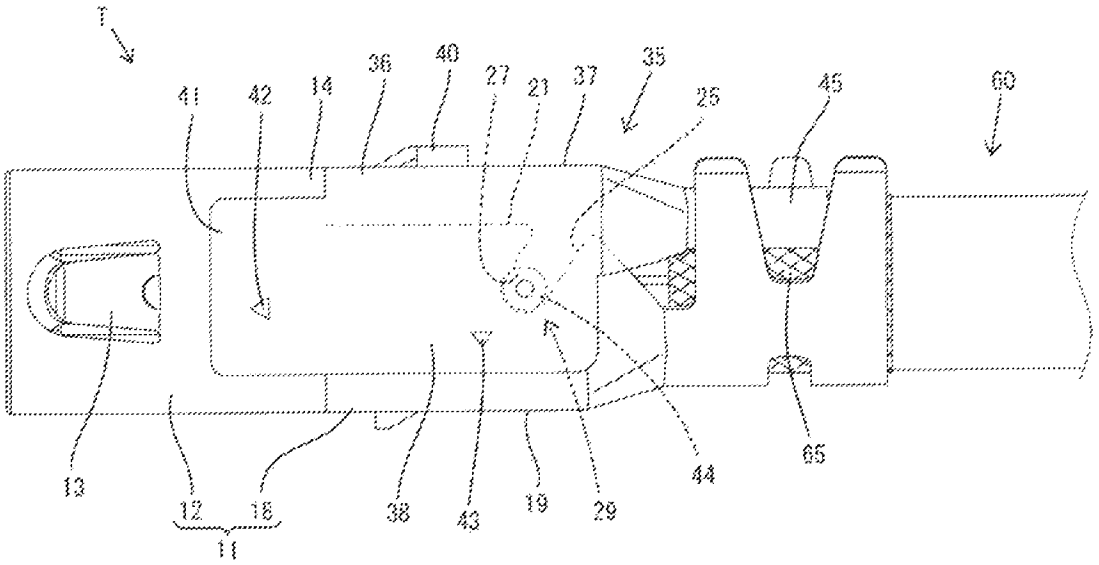
FIG. 13 is a side view showing a state where the assembling of the tubular member, the lower member and the upper member is completed.

In the process of swinging the upper member 35, the second guide pins 44 slide along edges of the second guide grooves 25 to stabilize a swing trajectory of the upper member 35 in the vertical direction and front-rear direction. Further, the left and right outer plate parts 38 slide in contact with the outer surfaces of the inner plate parts 21 of the lower member 18 to position the upper member 35 in the lateral direction with respect to the body 11. As shown in FIG. 13, assembly of the upper member 35 with the body 11 is completed and the shield terminal T is configured when the second guide pins 44 reach the ends (front ends) of the second guide grooves 25.

With the assembling of the upper member 35 completed, the second guide pins 44 are locked to the second stoppers 27 and are held in back end parts of the second guide grooves 25. Additionally, the second hook 39 is locked conductively to the rear edge of the tubular member 12, the third locking portions 17 and the third locking projections 42 are locked conductively to each other, and the fifth locking portions 31 and the fifth locking projections 43 are locked conductively to each other. Thus, the body 11 and the upper member 35 are held in the assembled state with relative displacements in the front-rear direction and vertical direction restricted.

With the upper member 35 mounted on the body 11, an area of the upper member 35 except the second hook 39 is located entirely to be behind and continuous with the tubular member 12, and the upper member 35 and the lower member 18 are positioned to vertically face each other across the front end part of the shielded cable 60 and the rear end part of the dielectric 46. Further, the second cover 36 of the upper member 35 covers an inner side part of the first cover 19, the exposed areas of the front end parts of the cores 62 and the wire connecting portions 55 of the inner conductors 52 mounted in the conductor accommodation chambers 47 in the upper stage.

Further, the closing plate parts 41 of the upper member 35 cover: locking parts of the first locking portions 15 and the first locking projections 48, locking parts of the second locking portions 16 and the second locking projections 49, the third locking portions 17, locking parts of the fourth locking portions 30 and the fourth locking projections 50, the fifth locking portions 31, fitting parts of the first guide grooves 24 and the first guide pins 51 and fitting parts of the second guide grooves 25 and the second guide pins 44.

The first and second covers 19, 36 are connected conductively in locking parts of the third locking portions 17 and the third locking projections 42 and locking parts of the fifth locking portions 31 and the fifth locking projections 43. The front ends of the cores 62 and the wire connecting portions 55 of the inner conductors 52 are surrounded over the entire periphery by the first and second covers 19, 36 having a shielding function between the rear end of the tubular member 12 and the front end of the shield layer 65.

Figure 14:
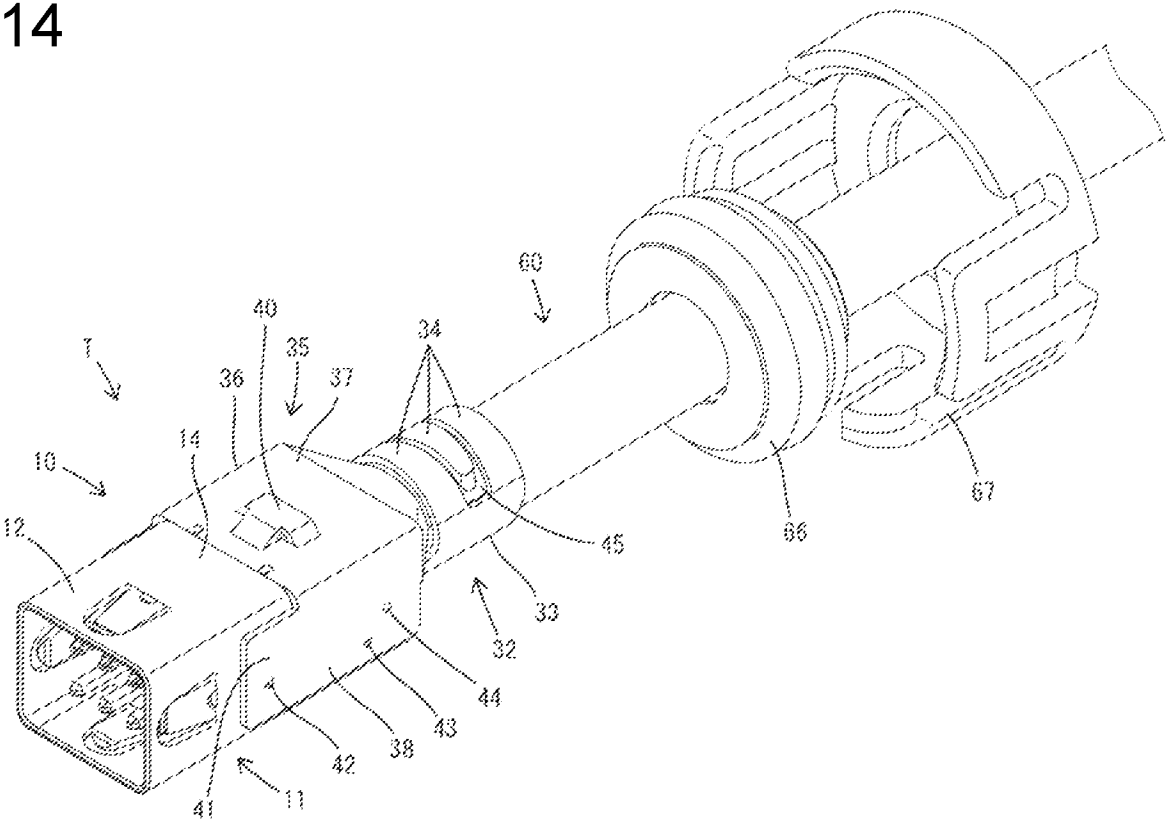
FIG. 14 is a perspective view of the shield terminal showing the state where the assembling of the tubular member, the lower member and the upper member is completed.

Further, the fixing portion 45 covers an upper surface area of the outer periphery of the front end part of the shield layer 65 and vertically sandwich the front end part of the shield layer 65 between the crimping portion 32 and the fixing portion 45. After the upper member 35 is assembled, the crimping portion 32 is crimped to the outer peripheries of the fixing portion 45 and the shield layer 65, as shown in FIG. 14. During crimping, the crimping pieces 34 are crimped into close contact with the outer periphery of the fixing portion 45. In this way, the inner peripheral surface of the base plate part 33 of the crimping portion 32 and the inner peripheral surface of the fixing portion 45 entirely surround the outer periphery of the shield layer 65 and are fixed conductively. In the above way, the assembling of the shield terminal T is completed.

Thereafter, the shield terminal T is inserted into the housing 2 from behind. Any further forward movement of the shield terminal T in an inserting direction is restricted by the butting portion 23 butting against the front stop 5 and the rearward escape thereof is restricted by locking the retaining projection 40 by the locking lance 4. Thus, the shield terminal T is retained and held. A rubber plug 66 and a rear holder 67 externally fit on the shielded cable 60 in advance subsequently are mounted in a rear end part of the housing 2 to complete the assembling of the shield connector 1.

The shield terminal T of this embodiment includes the inner conductors 52 to be connected to the front parts of the cores 62 of the shielded cable 60, the dielectric 46 for accommodating the inner conductors 52, the outer conductor 10 and the first guide means 28. The outer conductor 10 includes the tubular member 12 for surrounding and holding the dielectric 46, and the lower member 18 separate from the tubular member 12 and having the crimping portion 32 connectable to the shield layer 65 of the shielded cable 60. The first hook 22 is formed on the front end part of the lower member 18 and is lockable to the rear edge of the tubular member 12. The first guide means 28 guides the lower member 18 to a proper assembly position while allowing the lower member 18 to swing with the first hook 22 as a fulcrum.

The dielectric 46 is surrounded by the tubular member 12 in the shield terminal T. Thus, the reliability of the shielding function is high. Further, since the crimping portion 32 is not present behind the tubular member 12 in a state before the lower member 18 is assembled with the tubular member 12, work efficiency in mounting the dielectric 46 into the tubular member 12 from behind is good. Further, work efficiency is good since the lower member 18 is guided by the first guide means 28 when assembling the lower member 18 with the tubular member 12.

Further, the crimping portion 32 is in the form of an open barrel and is crimped to the outer periphery of the shield layer 65. The first hook 22 is locked to an inner peripheral edge of the tubular member 12. In crimping the crimping portion 32 to the shield layer 65, the front part of the lower member 18 is going to be lifted and displaced radially outward (downwardly of the tubular member 12) by a reaction force during crimping. However, the first hook 22 formed on the front part of the lower member 18 is locked to the inner edge of the rear end part of the tubular member 12. Thus, the front end part of the lower member 18 cannot be lifted.

Further, the first guide means 28 is formed in the lower member 18 and the dielectric 46. Thus, the shape of the tubular member 12 can be simplified as compared to the case where the tubular member 12 is formed with a guide means. Further, the first guide means 28 is composed of the first guide pins 51 formed on the dielectric 46 and the first guide grooves 24 formed in the lower member 18, with the first guide pins 51 sliding in contact with the first guide grooves 24. According to this configuration, the tubular member 12 need not be formed with any guide means. Thus, the shape of the tubular member 12 can be simplified.

Further, the shield terminal T of this embodiment includes the outer conductor 10 and the second guide means 29. The outer conductor 10 is configured by assembling the body 11 and the upper member 35. The body 11 includes the tubular holding portion 14 for surrounding and holding the dielectric 46 and the crimping portion 32 to be connected to the front end part of the shield layer 65 of the shielded cable 60. The upper member 35 is separate from the body 11 and surrounds the cores 62 over the entire periphery together with the body 11 between the rear end of the holding portion 14 and the front end of the shield layer 65. Since the body 11 and a cover surround the cores 62 over the entire periphery between the rear end of the holding portion 14 and the front end of the shield layer 65, the reliability of the shielding function is improved.

Further, the second hook 39 is formed on the front part of the upper member 35 and is lockable to the rear end edge of the holding portion 14. The second guide means 29 guides the upper member 35 to a proper assembly position while allowing the upper member 35 to swing with the second hook 39 as a fulcrum. According to this configuration, the upper member 35 is guided efficiently by the second guide means 29 when assembling the upper member 35 with the body 11.

Further, the upper member 35 is formed with the fixing portion 45 to be crimped to the outer periphery of the shield layer 65, and the second hook 39 is locked to an inner peripheral edge of the holding portion 14. According to this configuration, reaction forces generated when crimping the fixing portion 45 to the shield layer 65 urge the front part of the upper member 35 radially outward (upwardly of the upper member 35) by a reaction force during crimping. However, the second hook 39 on the front part of the upper member 35 is locked to the inner edge of the rear end part of the holding portion 14. Thus, the front part of the upper member 35 cannot lift.

Further, the body 11 is configured by assembling the tubular member 12 formed with the holding portion 14 and the lower member 18 formed with the crimping portion 32. According to this configuration, the crimping portion 32 is not present behind the tubular member 12 in the state before the lower member 18 is assembled with the tubular member 12. Thus, the dielectric 46 can be mounted efficiently into the tubular member 12 from behind.

Further, since the second guide means 29 is formed in the upper member 35 and the lower member 18, the shape of the tubular member 12 can be simplified as compared to the case where the tubular member 12 is formed with a guide means. Further, the second guide means 29 is composed of the second guide pins 44 formed on the upper member 35 and the second guide grooves 25 formed in the lower member 18, with the second guide pins 44 sliding in contact with the second guide grooves 25. According to this configuration, the tubular member 12 need not be formed with any guide means, and the shape of the tubular member 12 can be simplified.

The outer conductor 10 of the shield terminal T includes the tubular member 12 for surrounding and holding the dielectric 46, the lower member 18 separate from the tubular member 12 and to be connected to the front end part of the shield layer 65 of the shielded cable 60, and the upper member 35 to be connected to the front end part of the shield layer 65. The lower member 18 and the upper member 35 constitute divided shells having a half-divided shape. The lower member 18 and the upper member 35 are formed with the first cover 19 and the second cover 36 for surrounding the cores 62 and the wire connecting portions 55 of the inner conductors 52 over the entire periphery between the rear end of the tubular member 12 and the front end of the shield layer 65.

According to this configuration, the first and second covers 19, 36 surround the cores 62 and the wire connecting portions 55 over the entire periphery between the rear end of the tubular member 12 and the front end of the shield layer 65. Thus, the reliability of the shielding function is high. Further, the divided shells (lower member 18 and upper member 35) formed with the first and second covers 19, 36 are separate from the tubular member 12 and half-divided. Thus, with the dielectric 46 and the inner conductors 52 mounted in the tubular member 12, an operation of connecting the inner conductors 52 to the cores 62 can be performed. Therefore, the shield terminal T of this embodiment can reduce restrictions of the assembling process.

Further, the crimping portion 32 to be crimped to the outer periphery of the shield layer 65 is formed on the rear end part of the lower member 18, and the first hook 22 to be locked to the inner edge part of the rear end part of the tubular member 12 is formed on the front end part of the lower member 18 formed with the crimping portion 32. According to this configuration, a reaction force generated when crimping the crimping portion 32 to the shield layer 65 urges the front part of the lower member 18 radially outward of the lower member 18. However, the first hook 22 formed on the front end part of the lower member 18 is locked to the inner edge of the rear end part of the tubular member 12 from inside (upper surface side). Thus, the front end part of the lower member 18 cannot be lifted radially outward.

Further, the shield terminal T includes the first guide means 28. The first guide means 28 guides the lower member 18 to the proper assembly position while allowing the lower member 18 to swing with the first hook 22 as a fulcrum. Thus, the lower member 18 can be assembled with the tubular member 12 and the dielectric 46 without interfering with other members by the first guide means 28.

Further, the upper member 35 is formed with the fixing portion 45 for covering a part of the outer periphery of the shield layer 65. The lower member 18 is formed with the crimping portion 32 to be crimped to the outer periphery of the shield layer 65 and including the crimping pieces 34 to be crimped to the outer periphery of the fixing portion 45. According to this configuration, the lower member 18 and the upper member 35 can be fixed to the shield layer 65 merely by a process of crimping the crimping portion 32 while crimping the crimping pieces 34 to the outer periphery of the fixing portion 45.

The invention is not limited to the above described and illustrated embodiment. For example, the following embodiments also are included in the scope of the invention.

Although the first guide means is formed in the lower member (connecting member) and the dielectric in the above embodiment, the first guide means may be formed in the lower member and the tubular member.

Although the first guide pins are formed on the outer surface of the dielectric and the first guide grooves are formed in the lower member (connecting member) in the above embodiment, the first guide pins may be formed on the lower member and the first guide grooves may be formed in the dielectric.

Although the hooking portions are formed on both the lower member (connecting member) and the upper member in the above embodiment, a hook may be formed only on the lower member.

Although the crimping portion is formed only on the lower member (connecting member) in the above embodiment, crimping portions may be formed on both the lower member and the upper member.

Although both the lower member and the upper member are fixed to the shield layer only by the process of crimping the crimping portion of the lower member (connecting member) in the above embodiment, a process of fixing the upper member to the shield layer may be performed separately from a process of crimping the lower member to the shield layer.

Although the inner conductors and the cores are connected with the inner conductors mounted in the dielectric in the above embodiment, the present invention can be applied also when the inner conductors are mounted into the dielectric after being connected to the cores.

Although the inner conductor is a male terminal including an elongated tab in a front part in the above embodiment, the present invention can be applied also when the inner conductor is a female terminal including a rectangular tube portion in a front end part.

LIST OF REFERENCE SIGNS

T . . . shield terminal
10 . . . outer conductor
12 . . . tubular member
18 . . . lower member (connecting member)
22 . . . first hook (hook)
24 . . . first guide groove (guide groove)
28 . . . first guide means (guide means)
32 . . . crimping portion
46 . . . dielectric
51 . . . first guide pin (guide pin)
52 . . . inner conductor
60 . . . shielded cable
62 . . . core
65 . . . shield layer

The invention claimed is:

1. A shield terminal, comprising:

an inner conductor to be connected to a front part of a core of a shielded cable;

a dielectric configured to accommodate the inner conductor;

a tubular member constituting an outer conductor, the tubular member surrounding and holding the dielectric;

a connecting member separate from the tubular member and constituting the outer conductor, the connecting member including a crimping portion connectable to a shield layer of the shielded cable;

a hook formed on a front end part of the connecting member, the hook being lockable to a rear edge of the tubular member; and a guide means configured to guide the connecting member to a proper assembly position while allowing the connecting member to swing with the hook as a support;

wherein:

the guide means includes:

left and right guide pins formed on both left and right outer side surfaces of the dielectric; and left and right guide grooves formed in left and right inner plate parts constituting the connecting member, the guide pins sliding in contact with the guide grooves; and the guide grooves are formed by being cut obliquely rearward from front end edges of the inner plate parts.

2. The shield terminal of claim 1, wherein:

the crimping portion is crimped to an outer periphery of the shield layer; and the hook is locked to an inner peripheral edge part of the tubular member.

* * * * *